US005754006A

United States Patent [19]

Tonegawa

[11] Patent Number: 5,754,006

[45] Date of Patent: May 19, 1998

[54] BROAD-BAND TRAVELING-WAVE TUBE WITH OFFSETS ON POLE PIECES AND SPACERS

[75] Inventor: Satoshi Tonegawa, Tokyo, Japan

[73] Assignee: NEC Corporation, Tokyo, Japan

[21] Appl. No.: 617,729

[22] Filed: Apr. 1, 1996

[30] Foreign Application Priority Data

Mar. 31, 1995 [JP] Japan ..... 7-075123

[51] Int. Cl.[6] ..... H01J 25/34

[52] U.S. Cl. ..... 315/3.5; 315/39.3

[58] Field of Search ..... 315/3.5, 3.6, 5.35, 315/39.3

[56] References Cited

U.S. PATENT DOCUMENTS

| | | | |
|---|---|---|---|
| 3,293,478 | 12/1966 | Winkler | 315/3.5 |
| 3,398,314 | 8/1968 | Buck | 315/3.5 |
| 3,551,729 | 12/1970 | Bradford | 315/3.5 |
| 3,654,509 | 4/1972 | Scott et al. | 315/3.5 |
| 3,809,949 | 5/1974 | Scott | 315/3.5 |
| 3,885,192 | 5/1975 | Esterson et al. | 315/3.5 |

FOREIGN PATENT DOCUMENTS 4-85637 7/1992 Japan .

OTHER PUBLICATIONS

Kumar et al., "Modeling of a Vane–Loaded Helical Slow–Wave Structure for Broad–Band Traveling–Wave Tubes", *IEEE Transactions on Electron Devices*, vol. 36, No. 9, Sep. 1989, pp. 1991–1999.

Patent Abstracts of Japan, vol. 13, No. 8 (E–702), Jan. 10, 1989 (JPA 63218123).

*Primary Examiner*—Robert Pascal

*Assistant Examiner*—Justin P. Bettendorf

*Attorney, Agent, or Firm*—Sughrue, Mion, Zinn, Macpeak & Seas, PLLC

[57] ABSTRACT

A broad-band traveling-wave tube is provided, which contains a cylindrical waveguide made of a plurality of pole pieces and a plurality of spacers alternately arranged along its axis. A helix is placed in the waveguide to extend along the axis of the waveguide. The helix is held by helix supports not to be contacted with the waveguide. The inner wall of the waveguide has a plurality of offsets arranged at intervals along the axis of the waveguide. A bore-diameter-varying portion can be created inside a waveguide without mounting vanes.

3 Claims, 7 Drawing Sheets

BROAD-BAND TRAVELING-WAVE TUBE WITH OFFSETS ON POLE PIECES AND SPACERS

BACKGROUND OF THE INVENTION

1. Field of the Invention

The present invention relates to a traveling-wave tube and more particularly, to a broad-band traveling-wave tube that is effectively used for power amplification at microwave frequencies.

2. Description of the prior art

Microwave power is in wide spread use in such a variety of application fields as communications, Electro Counter Measure (ECM), radar, industrial heating, particle accelerator, radio astronomy, and nuclear fusion. To meet the demand of society for handling a high-level of information in the coming century, the field of communications among the above various fields has been increasingly becoming important in application of microwave power.

As a typical microwave tube for use at repeater stations of microwave communications or for satellite communications, a "traveling-wave tube" that uses an electron beam to amplify microwave power is available. The traveling-wave tube has a slow-wave structure that provides an interaction between a microwave input signal and an electron beam.

A typical slow-wave structure is a helix, which is coaxially arranged in a cylindrical waveguide. The helix is held by dielectric supports not in contact with the waveguide. The helix provides such features as simple structure, easy fabrication, and broad-band functioning capability and therefore, it has been widely applied.

An example of the conventional traveling-wave tubes equipped with the helix-type slow-wave structure is shown in FIG. 1.

As shown in FIG. 1, this traveling-wave tube is partitioned into three sections, i.e., an electron beam (E-beam) source section 10, an interaction section 20, and a collector section 30. In the E-beam source section 10, an electron beam EB is generated and emitted toward the interaction section 20. In the interaction section 20, an interaction between the electron beam EB emitted from the source section 10 and a radio-frequency (RF) electromagnetic field caused by an applied microwave input signal takes place. In the collector section 30, the electron beam EB having passed through the interaction section 20 is collected.

The traveling-wave tube has a cylindrical vacuum envelope 1, an electron gun 11 fixed to one end of the envelope 1, and a collector 31 fixed to the other end thereof. In the envelope 1, a focusing electrode 12 is fixed to focus or narrow the electron beam ED emitted from the gun 11. The electron gun 11 and the focusing electrode 12 constitute the E-beam source section 10.

In the interaction section 20, a conductive helix 21 forming a slow-wave structure is provided coaxial in a cylindrical waveguide 26. The helix 21 is made of a metal such as molybdenum (Mo) or tungsten (W). The helix 21 is held by dielectric supports 22 placed between the helix 21 and the inner wall of the waveguide 26. The supports 22, which have a shape of a straight bar, extend along the axis of the helix 21 from one end of the helix 21 to the other end thereof.

Both ends of the helix 21 protrude outside from the vacuum envelope 1. A microwave input signal is supplied to the helix 21 through its one end 21*a*. The input signal is amplified in the interaction section 20 due to the interaction between the traveling electron beam EB and the RF field caused by the input signal and then, it is taken out through the other end 21*b*.

The waveguide 26 is made of a plurality of pole pieces 23 and a plurality of spacers 24 which are alternately arranged along the axis of the cylindrical vacuum envelope 1 and which are coupled together. The pole pieces 23 are made of a magnetic material. The spacers 24 are made of a non-magnetic material.

The pole pieces 23 are of a circular ringed shape and have cylindrical cavities therein. The spacers 24 are also of a circular ringed shape and have cylindrical cavities therein. The pole pieces 23 and the spacers 24 are connected together to couple their cavities with each other, thereby producing the cylindrical waveguide 26.

A plurality of permanent magnet pieces 25, which have a circular ringed shape, are placed outside the respective spacers 24. In other words, the magnet pieces 25 are arranged at regular intervals along the axis of the waveguide 26. The magnet pieces 25 and the pole pieces 23 produce a focusing magnetic field that focuses the electron beam EB traveling through the waveguide 26.

Thus, the interaction section 20 contains the helix 21, supports 22, pole pieces 23, spacers 24 and magnet pieces 25.

As seen from FIG. 1, the interaction section 20 is further partitioned into an input subsection 20*a* and an output subsection 20*b*. Electric power is supplied to the microwave input signal in the input subsection 20*a*, and the electric power is then taken out in the output subsection 20*b*.

The electron beam ER having passed through the waveguide 26 in the interaction section 20 is collected by a collector 31 disposed in the collector section 30.

With the conventional traveling-wave tube shown in FIG. 1, to make the slow-wave structure suitable for broad-band applications such as communications, the slow-wave structure must have a response as flat as possible over a wide range of microwave frequencies. In recent years, the operation band of the traveling-wave tube has been required to be ultra broad for use in such applications as communications, ECM, and radar. However, the interaction between the electron beam EB and the RF field tends to greatly vary depending upon the frequency and consequently, it is difficult for the slow-wave structure of the above conventional tube to realize a broad-band functioning capability.

To solve this difficulty, an improvement of the slow-wave structure was developed, which was disclosed in the Japanese Non-Examined Utility-Model Publication No. 4-85637 in July, 1992.

In this improved structure, as shown in FIG. 2, vanes 27 are fixed onto the inner wall 26*a* of the waveguide 26, thereby forming offsets on the wall 26*a*. With the use of this structure, the phase velocity of a traveling wave through the slow-wave structure can be made substantially uniform for frequency. Thus, this improved structure is effective for providing a broad-band functioning capability.

The Japanese Non-Examined Utility-Model Publication No. 4-85637 also disclosed the structure as shown in FIG. 3, where projections 28 are formed on the inner wall 26*a* of the waveguide 26 instead of the vanes 27. The projections 28 are made by deforming the wall 26*a* toward the inside. This variation can provide the same effect as that of FIG. 2.

The effects of the vanes 27 were, for example, clarified in the IEEE Transactions on Electron Devices, Vol. 36, No. 9, pp. 1991 to 1999, September 1989. This article disclosed the structures as shown in FIG. 4 and 5.

In this article, the effects of the vanes 27 were analyzed using the structure of FIG. 5, in which the angular periodicity $\theta_t$ and the ratio ($a_v/a$) were used as parameters. Here, the character $a_v$ indicates the bore radius of the vanes 27, and the character a indicates the radius of the helix 21. The article reported the following results:

The phase velocity of a wave traveling through the slow-wave structure tends to decrease slightly with the decreasing value of the ratio ($a_v/a$). This phase-velocity decreasing effect is more conspicuous at lower frequencies. When the value of the ratio ($a_v/a$) is greater than a certain value, the phase velocity barely varies even with the frequency change. However, when the value of the ratio ($a_v/a$) is reduced to the certain value or less, the phase velocity tends to decrease with the lowering frequency.

The effect of the vanes 27 as stated above tends to be more conspicuous as the value of $\theta_t$ increases. Accordingly, in the actual design process, a compromise between the values of ($a_v/a$) and $\theta_t$ is found to thereby provide a phase velocity as uniform as possible over a wide frequency range, thus making the microwave tube suitable for use in broad-band applications.

FIG. 6 shows the relationship between the frequency f and the phase velocity $v_p$ disclosed in the above article, where the frequency f is normalized by the frequency $f_O$ and the phase velocity $v_P$ is normalized by the light speed c. The curve A shows the relationship obtained by actual measurement and the curve B shows the relationship obtained by calculation.

As stated above, with the conventional traveling-wave tube, it is required to mount vanes 27 on the inner wall 26*a* of the waveguide 26 or to deform the wall 26*a* over a certain length.

For example, to realize a broad-band traveling-wave tube for use in the frequency band of 4 GHz to 12 GHz, it is necessary for the average radius of the helix 21 to be approximately 1.5 mm, the bore diameter of the vanes 27 to be approximately 2 mm, the angular periodicity $\theta_t$ to be 40° to 70°, and the angular thickness of the dielectric supports 22 to be approximately 0.5 mm.

With these values, the angular thickness of the vanes 27 becomes approximately 1.5 mm. Thus, it is technically possible, but industrially difficult, to mount three vanes 27 at angular intervals of 120° in equally spaced locations and yet over a distance of 200 mm or longer.

Making a slow-wave structure for use in the millimeter wave band is practically impossible because components must be built to approximately half the dimensions as given above.

SUMMARY OF THE INVENTION

Accordingly, an objective of the present invention is to provide a broad-band traveling-wave tube without using the vanes.

Another objective of the present invention is to provide a broad-band traveling-wave tube that can be fabricated even for use in the millimeter wave band.

The above objects together with others not specifically mentioned, will become clear to those skilled in the art from the following description.

A broad-band traveling-wave tube according to the present invention contains a waveguide made of a plurality of pole pieces and a plurality of spacers which are alternately arranged along the axis of the waveguide. The inner wall of the waveguide has a plurality of offsets arranged at intervals along the axis of the waveguide.

In the broad-band traveling-wave tube of the present invention, the inner wall of the waveguide, which is made of the plurality of pole pieces and the plurality of spacers, has a plurality of offsets arranged at intervals along the axis of the waveguide. Therefore, an equivalent effect to that of the conventional vanes is obtained. This means that a broad-band traveling-wave tube can be obtained without using the conventional vanes.

Because, the broad-band traveling-wave tube of the present invention uses no vanes, a broad-band traveling-wave tube for use in the millimeter wave band can be fabricated.

In a preferred embodiment of the invention, the offsets are produced by outwardly depressed areas and/or inwardly protruded areas formed on the respective inner surfaces of the pole pieces and the spacers.

In another preferred embodiment of the invention, the offsets are formed for only the pole pieces and the spacers in the output subsection of the interaction section, and no offsets are provided for those in the input subsection thereof.

BRIEF DESCRIPTION OF THE DRAWINGS

In order that the invention may be readily carried into effect, it will now be described with reference to the accompanying drawings.

DETAILED DESCRIPTION OF THE PREFERRED EMBODIMENTS

Figure 1:
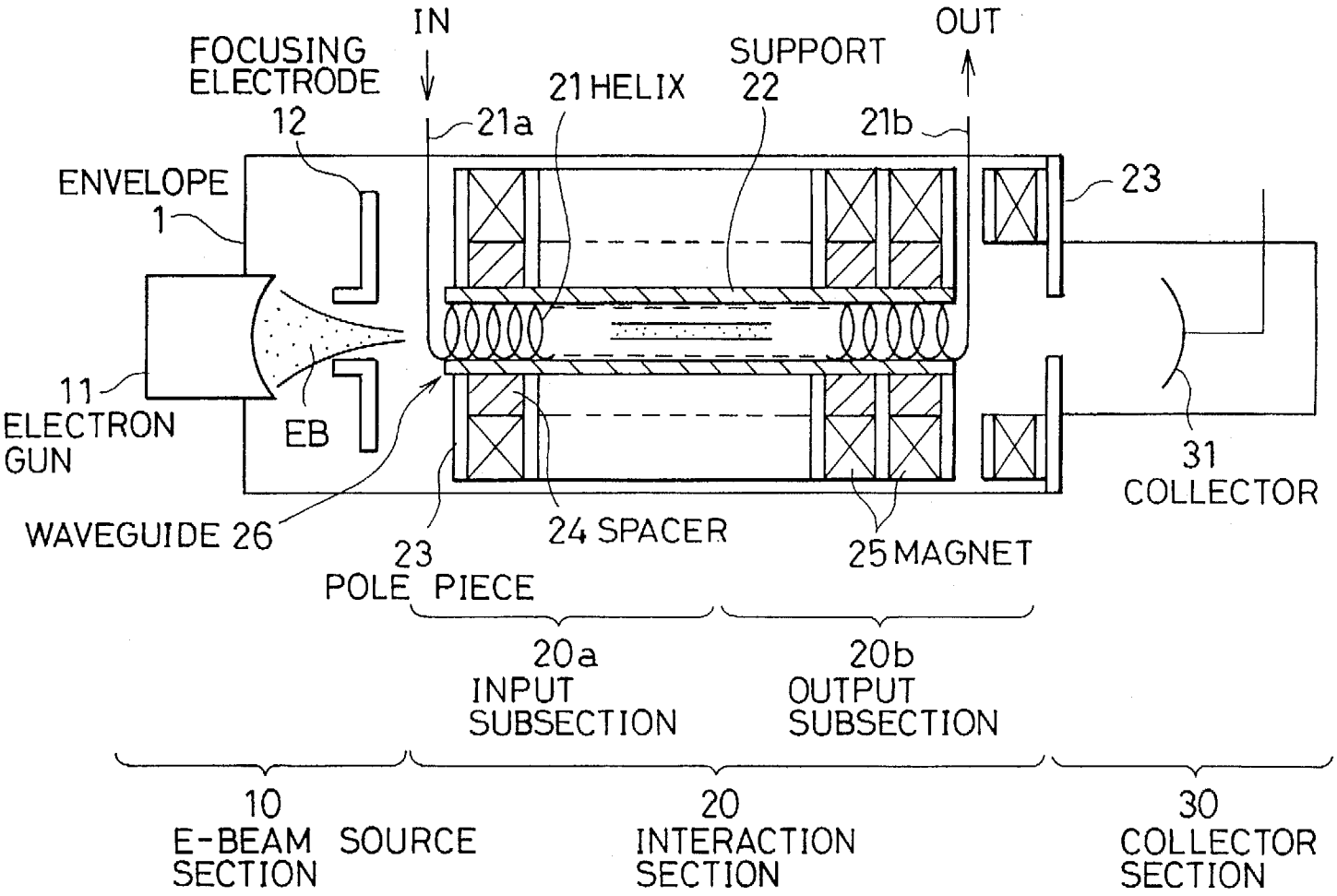
FIG.1 PRIOR ART
FIG. 1 is a schematic, axial cross-sectional view of a conventional traveling-wave tube.
Figure 2:
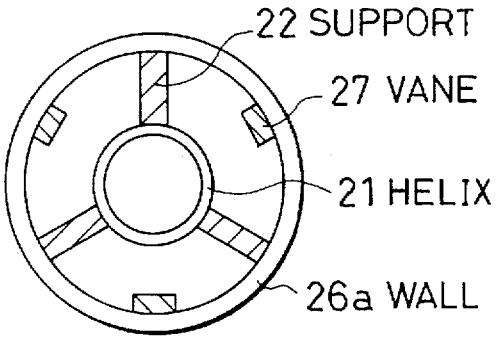
FIG. 2 PRIOR ART
FIG. 2 is a schematic, radial cross-sectional view of a first example of conventional slow-wave structures.
Figure 3:
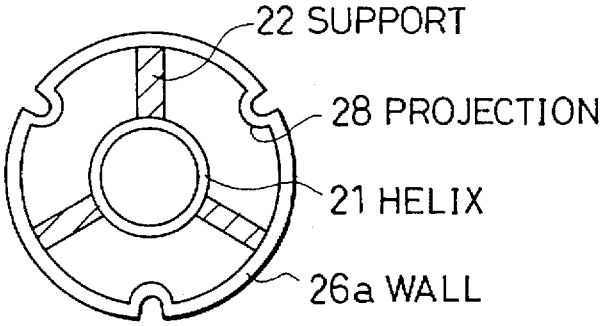
FIG. 3 PRIOR ART
FIG. 3 is a schematic, radial cross-sectional view of a second example of conventional slow-wave structures.
Figure 4:
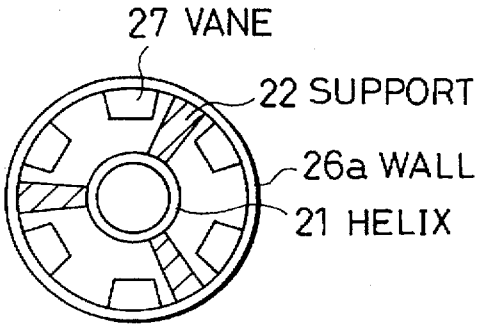
FIG. 4 PRIOR ART
FIG. 4 is a schematic radial cross-sectional view of a third example of conventional slow-wave structures.
Figure 5:
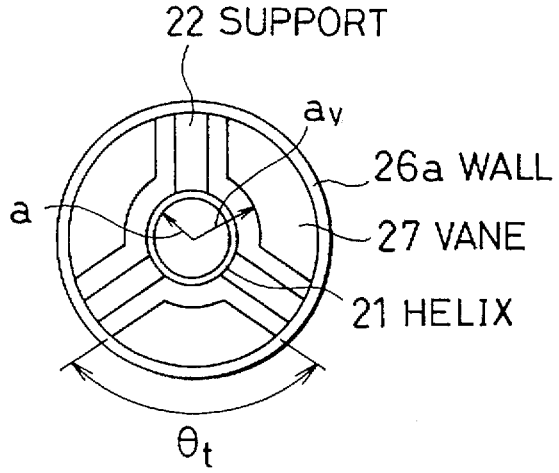
FIG.5 PRIOR ART
FIG. 5 is a schematic, radial cross-sectional view of a fourth example of conventional slow-wave structures.
Figure 6:
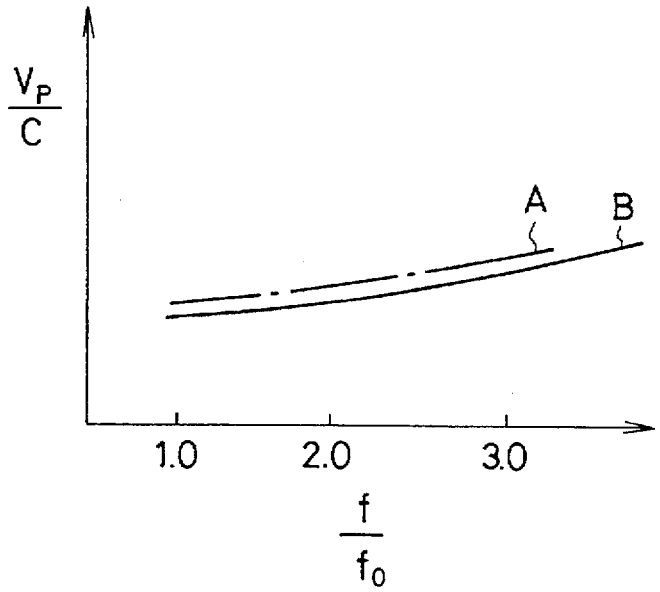
FIG.6 PRIOR ART
FIG. 6 is a graph showing the relationship of the phase velocity with the frequency for a conventional broad-band traveling-wave tube.

Preferred embodiments of the present invention will be described in detail below while referring to the drawings attached.

First Embodiment

A broad-band traveling-wave tube according to a first embodiment of the present invention has the same basic structure as that of the conventional one shown in FIG. 1. Therefore, the description relating to the same structure is omitted here for the sake of simplicity and only the different structures from the conventional one are explained below.

Figure 9:
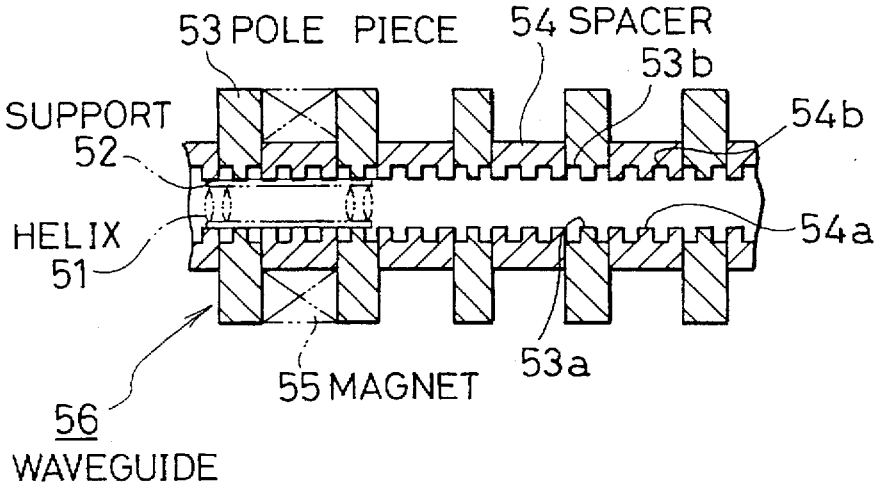
FIG. 9 is a schematic, axial cross-sectional view of a waveguide for a slow-wave structure according to a first embodiment of the invention.

The traveling-wave tube according to the first embodiment is equipped with a waveguide 56 as shown in FIG. 9 in the interaction section 20. The waveguide 56 is composed of a plurality of pole pieces 53 and a plurality of spacers 54, which are alternately arranged along the axis of the cylindrical vacuum envelope 1 and which are coupled together by brazing. The pole pieces 53 are made of a magnetic material. The spacers 54 are made of a non-magnetic material.

Each of the pole pieces 53 has a circular ringed shape and an approximately cylindrical cavity therein. Each of the spacers 54 also has a circular ringed shape and an approximately cylindrical cavity therein. The cavities of the pole pieces 53 and those of the spacers 54- are connected together to thereby produce the cylindrical waveguide 56.

A plurality of permanent magnet pieces 55, which have a circular ringed shape, are placed outside the respective spacers 54. In other words, the magnet pieces 55 are arranged at regular intervals along the axis of the waveguide 56. The magnet pieces 55 and the pole pieces 53 produce a focusing magnetic field that focuses the electron beam EB traveling through the waveguide 56.

Similar to the conventional tube as shown in FIG. 1, a conductive helix 51 forming a slow-wave structure is provided coaxial in the waveguide 56. The helix 51 is made of a metal such as molybdenum (Mo) or tungsten (W) . The helix 51 is held by three dielectric supports 52 placed between the helix 51 and the inner wall of the waveguide 56. The supports 52, which have a shape of a straight bar, extend along the axis of the helix 51 from one end of the helix 51 to the other end thereof.

Both ends of the helix 51 protrude outside from a vacuum envelope similar to the way both ends of helix 21 protrude outside from vacuum envelope 1 as shown in FIG. 1. A microwave input signal is supplied to the helix 51 through its one end. The input signal is amplified in an interaction section similar to the interaction section 20 as shown in FIG. 1 due to the interaction between the traveling electron beam EB and the RF field caused by the input signal and then, it is taken out through the other end.

Figure 10:
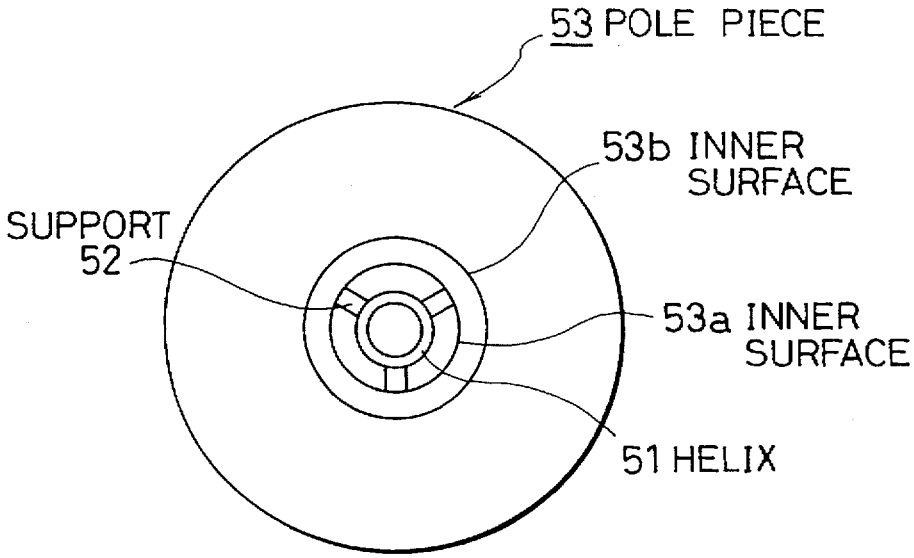
FIG. 10 is a schematic, radial cross-sectional view of the pole piece, which is used for the waveguide according to the first embodiment.
Figure 12:
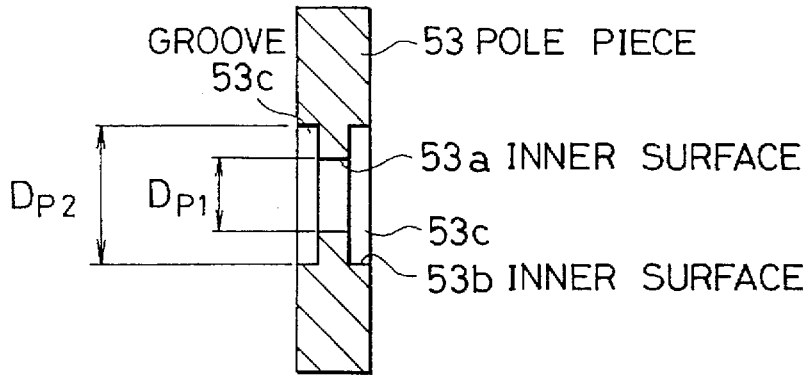
FIG. 12 is a schematic, axial cross-sectional view of the pole piece, which is used for the waveguide according to the first embodiment.

As shown in FIGS. 10 and 12, each of the pole pieces 53 has two circular grooves or depressions 53*c* at each end. The inner surface 53*a* of the piece 53 has a relatively smaller diameter $D_{p1}$. The inner surface 53*b* of the piece 53, which is the bottom of the groove 53*c*, has a relatively larger diameter $D_{p2}$.

Figure 11:
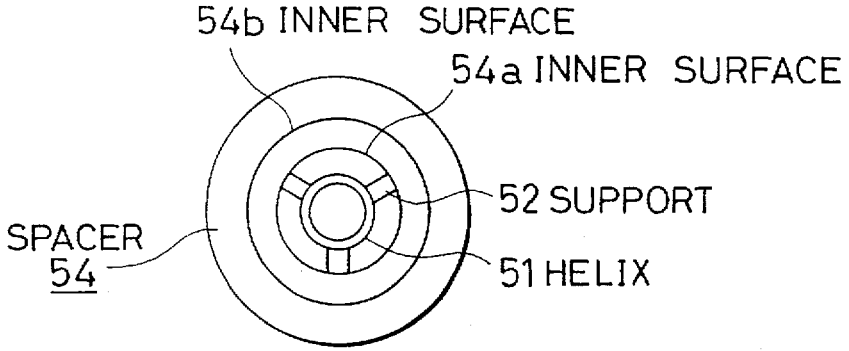
FIG. 11 is a schematic, radial cross-sectional view of the spacer, which is used for the waveguide according to the first embodiment.
Figure 13:
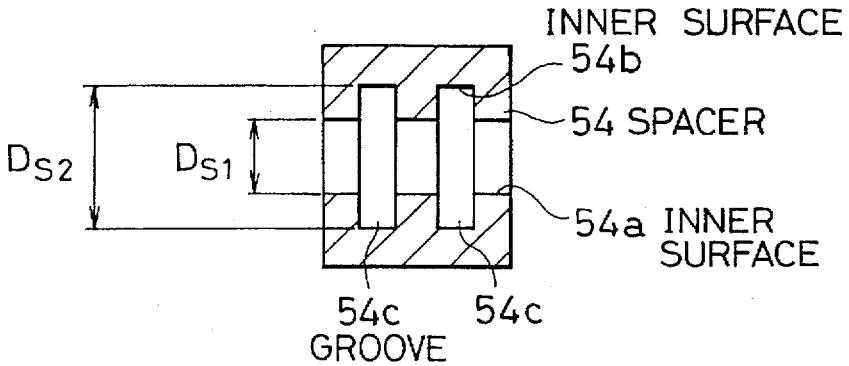
FIG. 13 is a schematic, axial cross-sectional view of the spacer, which is used for the waveguide according to the first embodiment.

Similarly, as shown in FIGS. 11 and 13, each of the spacers 54 has two circular grooves or depressions 54*c* formed at regular intervals along the axis of the spacer 54. The inner surface 54*a* of the spacer 54 has a relatively smaller Both ends of the helix 51 protrude outside from a vacuum envelope similar to the way both ends of helix 21 protrude outside from vacuum envelope 1 as shown in FIG. 1. diameter $D_{s1}$, where $D_{s1}=D_{p1}$. The inner surface 54*b* of the spacer 54, which is the bottom of the groove 54*c*, has a relatively larger diameter $D_{s2}$, where $D_{s2}=D_{p2}$.

In the traveling-wave tube of to the first embodiment, since the grooves 53*c* and 54*c* are periodically arranged along the axis of the waveguide 56 to thereby produce a plurality of offsets on the inner wall of the waveguide 56, an equivalent effect to that of the conventional vanes is obtained. As a result, a broad-band traveling-wave tube can be obtained without using the conventional vanes.

Also, because the broad-band traveling-wave tube of to the first embodiment uses no vanes, a broad-band traveling-wave tube for use in the millimeter wave band can be fabricated.

Next, the reason why the equivalent effect to that of the conventional vanes is obtained in the tube of the first embodiment will be clarified.

The equivalent effect is due to hollow spaces generated by the offsets.

Figure 7:
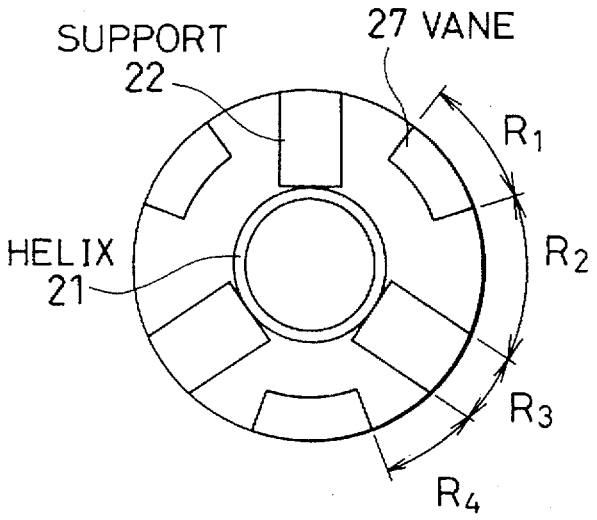
FIG. 7 PRIOR ART
FIG. 7 is a schematic, radial cross-sectional-view of the first example of conventional slow-wave structures.

In the conventional vane-loaded tube, the waveguide is divided into three sets of four different regions $R_1$, $R_2$, $R_3$ and $R_4$, which are arranged at angular intervals of 120°, as shown in FIG. 7. In the region $R_1$, the vane exists and therefore, the inner diameter of the bore is relatively small. In the region $R_2$, no vane and no support exist and therefore, the inner diameter of the bore is relatively large. In the region $R_3$, the support exists. In the region $R_4$, no vane and no support exist and therefore, the inner diameter of the bore is relatively large, which is identical with the region $R_2$.

Figure 8:
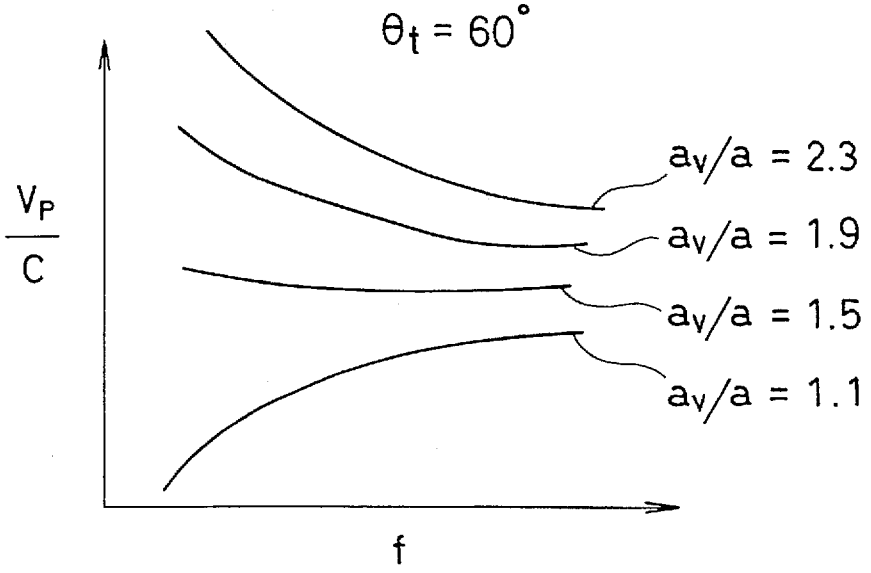
FIG. 8 PRIOR ART
FIG. 8 is a graph showing the relationship between the phase velocity and the frequency for the conventional broad-band traveling-wave tube.

For given vane dimensions, computer simulation of the phase velocity of a wave traveling through the interaction section 20 for frequency provides the relationship shown in FIG. 8. From FIG. 8, it is seen that, depending upon the selected value of $(a_v/a)$, the phase velocity can be made substantially uniform with the changing frequency, and thus the broad-band functioning capability can be provided. This tendency also depends upon the selected value of the angular periodicity $\theta_r$ of the vane.

In this technique, the slow-wave circuit including the vanes is treated as a model in which the helix is developed along a linear line and the helix supports are arranged in parallel to the linear line with respect to the electromagnetic field that travels along the helix, while rotating.

On the basis of this concept or technique, a model in which bore-diameter-varying pole pieces and spacers are arranged along the helical line of the helix can be treated as the same model. In other words, whether bore-diameter-varying pole pieces and spacers are arranged in the radial direction of the waveguide or they are arranged in the axial direction thereof, both the structures are equivalent to each other.

The present invention utilizes this principle and consequently, the same effects as those by the conventional tube can be obtained.

The optimum dimensions of the offsets are as follows:

With the conventional tubes using vanes, selecting the proper bore diameter of the vanes can provide a uniform phase velocity with respect to the frequency, as shown in FIG. 8. On the other hand, with the present invention, reducing the bore diameter by means of the convex offsets is equivalent to decreasing the bore diameter by means of the vanes in the conventional one. If the vane has the angular periodicity $\theta_t$ of 60°, a width equal to the pitch of the helix multiplied by (60°/360°) must be provided for the convex offset in the present invention.

The smaller bore diameter must be specified to be approximately 1.5 to 2 times the average radius of the helix 51 so that the phase velocity is substantially uniform with respect to the frequency, while the larger bore diameter must be 2 to 3 times as large as the average radius of the helix 51. The reasons why such smaller and larger bore diameters are specified are that, if the larger bore diameter exceeds the above upper limit, the required bore diameter of the electron-beam focusing magnet 55 increases, results in the required magnetic field not being achieved, and thus focusing the electron beam becomes difficult, and that, if the smaller bore diameter is under the lower limit, the impedance of the interaction section 20 decreases, resulting in the lowered efficiency of the microwave tube.

The pole pieces 53 are preferably made of iron, and are approximately half as thick as the spacers 54, which is made of a non-magnetic material. In addition, the thickness of the pole pieces 53 and that of the spacers 54 is preferably minimized so long as the proper magnetic field for focusing can be obtained.

Second Embodiment

Figure 14:
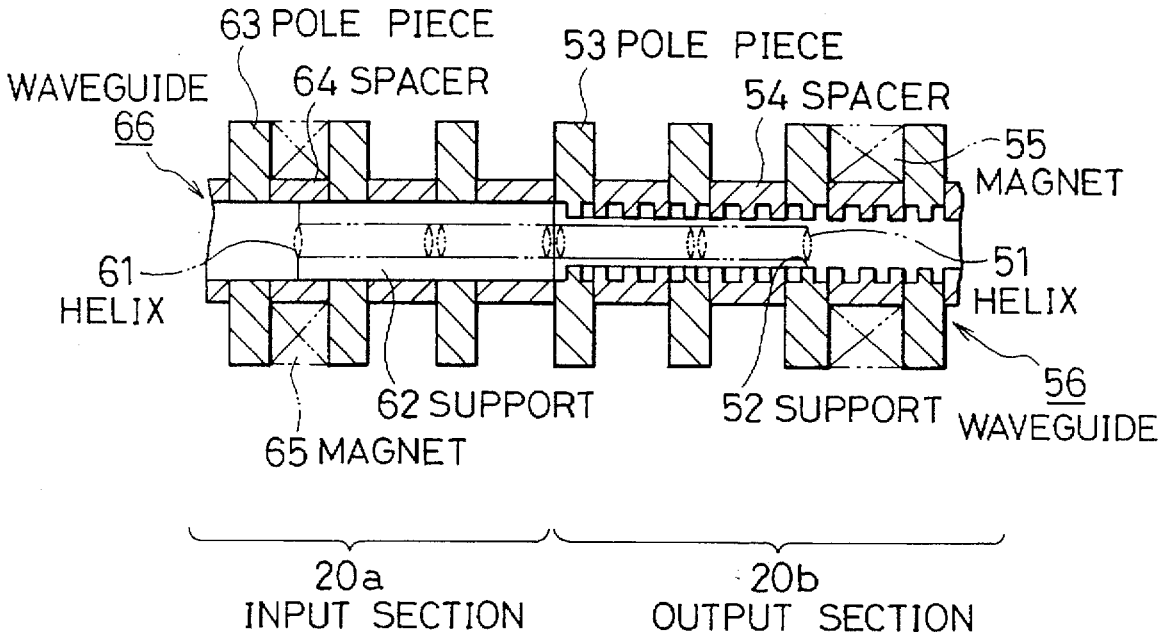
FIG. 14 is a schematic, axial cross-sectional view of a waveguide for a slow-wave structure according to a second embodiment of the invention.
Figure 15:
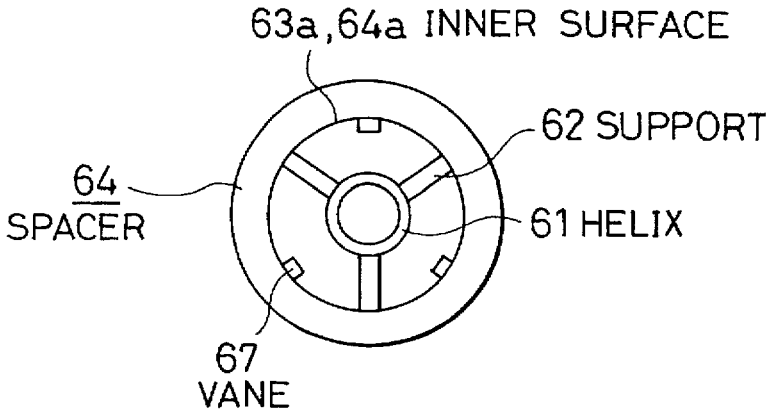
FIG. 15 is a schematic, radial cross-sectional view of the spacer placed in the input subsection, which is used for the waveguide according to the second embodiment.

A broad-band traveling-wave tube according to a second embodiment of the present invention is shown in FIGS. 14 and 15.

The difference of the second embodiment from the first embodiment is that only the waveguide 56 for the output subsection 20*b* of the interaction section 20 contains the offsets while a waveguide 66 for the input subsection 20*a* does not contain offsets. The waveguide 66 has conventional vanes 67 not shown in FIG. 14, but shown in FIG. 15. The other structure is the same as that of the first embodiment. It includes helix 51, 61, supports 52, 62, pole pieces 53, 63, spacers 54, 64, magnets 55, 65, and spacer inner surfaces 63*a*, 63*b*.

Accordingly, the second embodiment is equivalent to a tube which is obtained by applying the present invention to a vane-loaded traveling-wave tube.

With the second embodiment, the same advantage as that of the first embodiment can be obtained.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A broad-band traveling-wave tube comprising:

a waveguide made of a plurality of pole pieces with inner surfaces and a plurality of spacers with inner surfaces which are alternately arranged along the axis of said waveguide;

the inner wall of said waveguide having a plurality of offsets arranged at intervals along the axis of said waveguide:

a helix placed in said waveguide along the axis of said waveguide;

a helix support for supporting said helix said helix support being arranged between said inner wall of said waveguide and said helix;

wherein said offsets are produced by grooves formed in said inner surfaces of said pole pieces and on those of said spacers.

2. A broad-band traveling-wave tube comprising:

a waveguide made of a plurality of pole pieces with inner surfaces and a plurality of spacers with inner surfaces which are alternately arranged along the axis of said waveguide;

the inner wall of said waveguide having a plurality of offsets arranged at intervals along the axis of said waveguide;

a helix placed in said waveguide along the axis of said waveguide;

a helix support for supporting said helix, said helix support being arranged between said inner wall of said waveguide and said helix;

wherein said waveguide is partitioned into a first portion for an input subsection and a second portion for an output subsection;

and wherein only said second portion has said offsets.

3. The tube as claimed in claim 2, wherein said offsets are produced by grooves formed in said inner surfaces of said pole pieces and on those of said spacers.

* * * * *